US008955235B2

(12) United States Patent
Berner

(10) Patent No.: US 8,955,235 B2
(45) Date of Patent: Feb. 17, 2015

(54) OXIDATION FURNACE

(75) Inventor: Karl Berner, Altdorf (DE)

(73) Assignee: Eisenmann AG, Boeblingen (DE)

( * ) Notice: Subject to any disclaimer, the term of this patent is extended or adjusted under 35 U.S.C. 154(b) by 357 days.

(21) Appl. No.: 13/577,468

(22) PCT Filed: Jan. 29, 2011

(86) PCT No.: PCT/EP2011/000415

§ 371 (c)(1),
(2), (4) Date: Aug. 7, 2012

(87) PCT Pub. No.: WO2011/098223

PCT Pub. Date: Aug. 18, 2011

(65) Prior Publication Data

US 2012/0304479 A1 Dec. 6, 2012

(30) Foreign Application Priority Data

Feb. 9, 2010 (DE) ..... 10 2010 007 480

(51) Int. Cl.

| | |
|---|---|
| ***F26B 13/00*** | (2006.01) |
| ***F27B 9/28*** | (2006.01) |
| ***F27D 7/00*** | (2006.01) |
| ***D01F 9/32*** | (2006.01) |
| ***D02J 13/00*** | (2006.01) |
| ***F27B 9/30*** | (2006.01) |

(52) U.S. Cl.

CPC ..... *D01F 9/32* (2013.01); *D02J 13/001* (2013.01); *F27B 9/28* (2013.01); *F27B 9/3005* (2013.01); *F27D 7/00* (2013.01)

USPC ..... 34/224; 34/232; 34/620; 34/635; 34/638; 432/59; 432/199

(58) Field of Classification Search

USPC ..... 34/620, 629, 635, 636, 638, 643, 649, 34/650, 651, 653, 654, 655, 203, 210, 224, 34/225, 232, 233, 240; 432/59, 190, 199

See application file for complete search history.

(56) References Cited

U.S. PATENT DOCUMENTS

| | | | |
|---|---|---|---|
| 4,515,561 | A | 5/1985 | Melgaard |
| 4,559,010 | A | 12/1985 | Katsuki et al. |
| 5,142,796 | A | 9/1992 | Anzai et al. |

(Continued)

FOREIGN PATENT DOCUMENTS

| | | | |
|---|---|---|---|
| DE | 34 07 909 | A1 | 9/1984 |
| EP | 0 426 858 | A1 | 5/1991 |

(Continued)

*Primary Examiner* — Jiping Lu

(74) *Attorney, Agent, or Firm* — Factor Intellectual Property Law Group, Ltd.

(57) ABSTRACT

An oxidation furnace for the oxidative treatment of fibers, which, comprises a process chamber arranged inside a housing, a blowing device arranged in the center of the process chamber, a suction device arranged in the two opposite end regions of the process chamber, at least one ventilator that circulates the hot air through the blowing device, the process chamber and the suction devices, and at least one heating device arranged in the flow path of the hot circulated air. The blowing device comprises a plurality of vertically interspaced blowing boxes comprising an inlet, and, on opposite sides, outlets for the hot air. Two stacks of vertically interspaced blowing boxes may be provided, said blowing boxes being interspaced one behind the other in the direction of movement of the fibers, and/or the built-in boxes in a stack comprise at least one additional outlet in the upper side and the lower side, for hot air.

7 Claims, 4 Drawing Sheets

(56) References Cited

U.S. PATENT DOCUMENTS

| | | | | | |
|---|---|---|---|---|---|
| 5,263,265 | A | | 11/1993 | Melgaard | |
| 5,358,166 | A | * | 10/1994 | Mishina et al. | 228/42 |
| 5,908,290 | A | | 6/1999 | Kawamura et al. | |

FOREIGN PATENT DOCUMENTS

| | | | |
|---|---|---|---|
| EP | 0 484 090 | A2 | 5/1992 |
| JP | 2009242962 | A | 10/2009 |

* cited by examiner

OXIDATION FURNACE

RELATED APPLICATIONS

This application claims the filing benefit of International Patent Application No. PCT/EP2011/000415, filed Jan. 29, 2011, which claims the filing benefit of German Patent Application No. 10 2010 007 480.2, filed Feb. 9, 2010, the contents of both of which are incorporated herein by reference.

TECHNICAL FIELD AND BACKGROUND OF THE INVENTION

The invention relates to an oxidation furnace for the oxidative treatment of fibres, particularly for producing carbon fibres, having a) a housing which is gastight apart from inlet and outlet regions for the fibres;
b) a process chamber located in the interior of the housing;
c) a blowing device which is arranged in the central region of the process chamber and by means of which hot air can be blown in opposite directions into the process chamber and which comprises a plurality of blowing boxes which are arranged at a vertical spacing above one another and have respective exit openings on opposite sides for the hot air;
d) a respective suction device on both opposite end regions of the process chamber, which extracts hot air from the process chamber;
e) at least one ventilator which circulates the hot air through the blowing device, the process chamber and the two suction devices;
f) at least one heating device located in the flow path of the hot circulated air;
g) guide rollers which guide the fibres in serpentine manner through the clearances between blowing boxes located above one another.

There are various ways of conducting the hot air for treating fibres through an oxidation furnace. Oxidation furnaces which conduct the air according to the "centre-to-end" principle are gaining increasing acceptance. In this, the hot air is blown out in the central region of the process chamber in both directions, that is in the direction of the opposite ends of the process chamber, and extracted again by suction devices at these two ends of the process chamber. The process chamber can also be seen as a zone which can be repeated in the longitudinal direction of the furnace for different temperatures and air flows.

In known oxidation furnaces of the type mentioned at the outset, the blowing boxes forming the blowing device have continuous top and bottom sides and only have exit openings for the hot air at the opposite narrow end faces. This means that hot air does not flow through the clearances between blowing boxes located above one another, in any case not in a defined manner, and the fibres do not undergo oxidative treatment when passing through these clearances. Since the blowing boxes need to have considerable dimensions owing to the air distribution, the stretches in which there is no oxidative treatment of the fibres due to a lack of air flow are by no means insignificant.

SUMMARY OF THE INVENTION

An object of the present invention is to design an oxidation furnace of the type mentioned at the outset so that a stipulated stretch of the oxidative treatment of the fibres can be accommodated in a relatively small volume of the furnace, and in particular the furnace can be of a lower construction.

This object may be achieved according to the invention in that h) two stacks of blowing boxes arranged at a spacing above one another are provided, which are arranged at a spacing behind one another as seen in the movement direction of the fibres;

and/or i) the blowing boxes arranged above one another in a stack have at least one additional exit opening for hot air in the top side and the bottom side.

The basic idea is the same for both structural alternatives according to the invention, each of which can also essentially be realised in the same furnace:

In the first alternative, the dimensions of the blowing boxes is kept smaller as seen in the movement direction of the fibres, for instance so that the volume of two blowing boxes located behind one another corresponds to the overall volume of a single blowing box in the conventional design. The spacing between the two blowing boxes enables hot air flows to develop in the clearances between blowing boxes located above one another, which has not been realised as such in the prior art. The clearances between blowing boxes located above one another can thus actively participate in the oxidative treatment of the fibres.

The second structural alternative, in which the volume of the individual blowing boxes can be substantially the same as that of a conventional construction, behaves in similar manner. However, as a result of the additional air exit openings provided on the top and bottom sides, it is in turn possible to enable hot air to flow through the clearances between blowing boxes located above one another so that the portions of the fibres located there can participate in the oxidative process. Overall, this enables a smaller construction of the oxidation furnace since better use is made of the paths covered by the fibres than in the prior art.

It is particularly useful that, with the same furnace length, the furnace can be kept lower. This is linked to a whole range of advantages: since fewer serpentine passages of the fibres through the process chamber are required, it is possible to save on deflection rollers for the filaments and lock devices which prevent air from escaping in the region where the filaments enter and exit the process chamber. Moreover, the entire furnace is lower in weight, which is favourable in terms of expenditure on a steel structure on which the furnace is constructed. Moreover, the improved air flow around the filaments in the process chamber increases the quality of the resultant product.

It is expedient if the horizontal spacing between adjacently arranged stacks of blowing boxes is equal to double the vertical spacing between the blowing boxes in the stack and, at the most, equal to the dimensions of a blowing box in the longitudinal direction of the furnace. This produces defined flow conditions in the region between the stacks and in the regions between blowing boxes located above one another.

In the second structural alternative, it is favourable if the blowing boxes have a plurality of additional exit openings for hot air along a centre line on the top and bottom sides. This measure also serves to guide the hot air in controlled manner.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention are explained in more detail below with reference to the drawing which shows.

DETAILED DESCRIPTION OF THE PRESENT INVENTION

Figure 1:
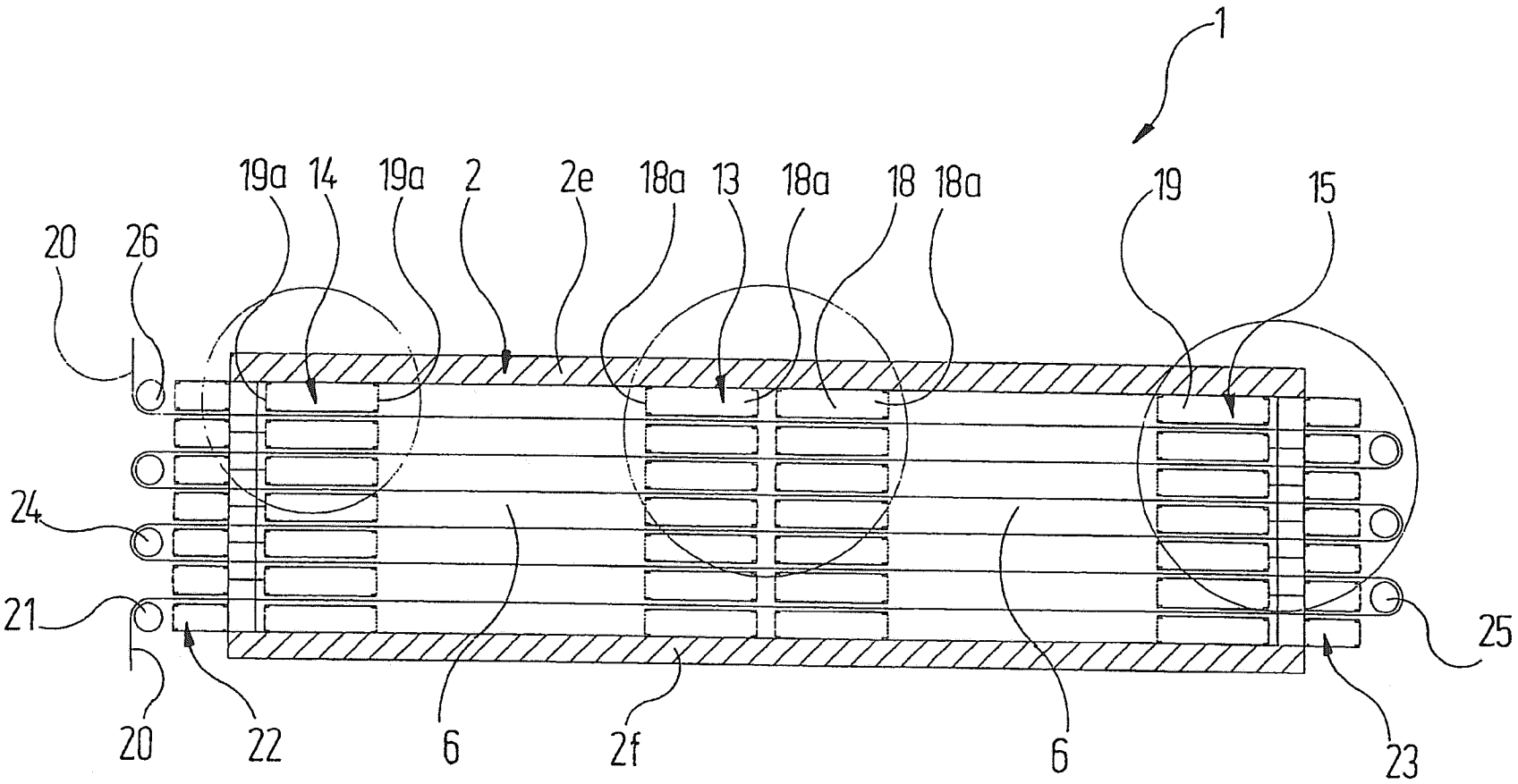
FIG. 1 a vertical section through an oxidation furnace for producing carbon fibres according to line I-I of FIG. 2.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Figure 2:
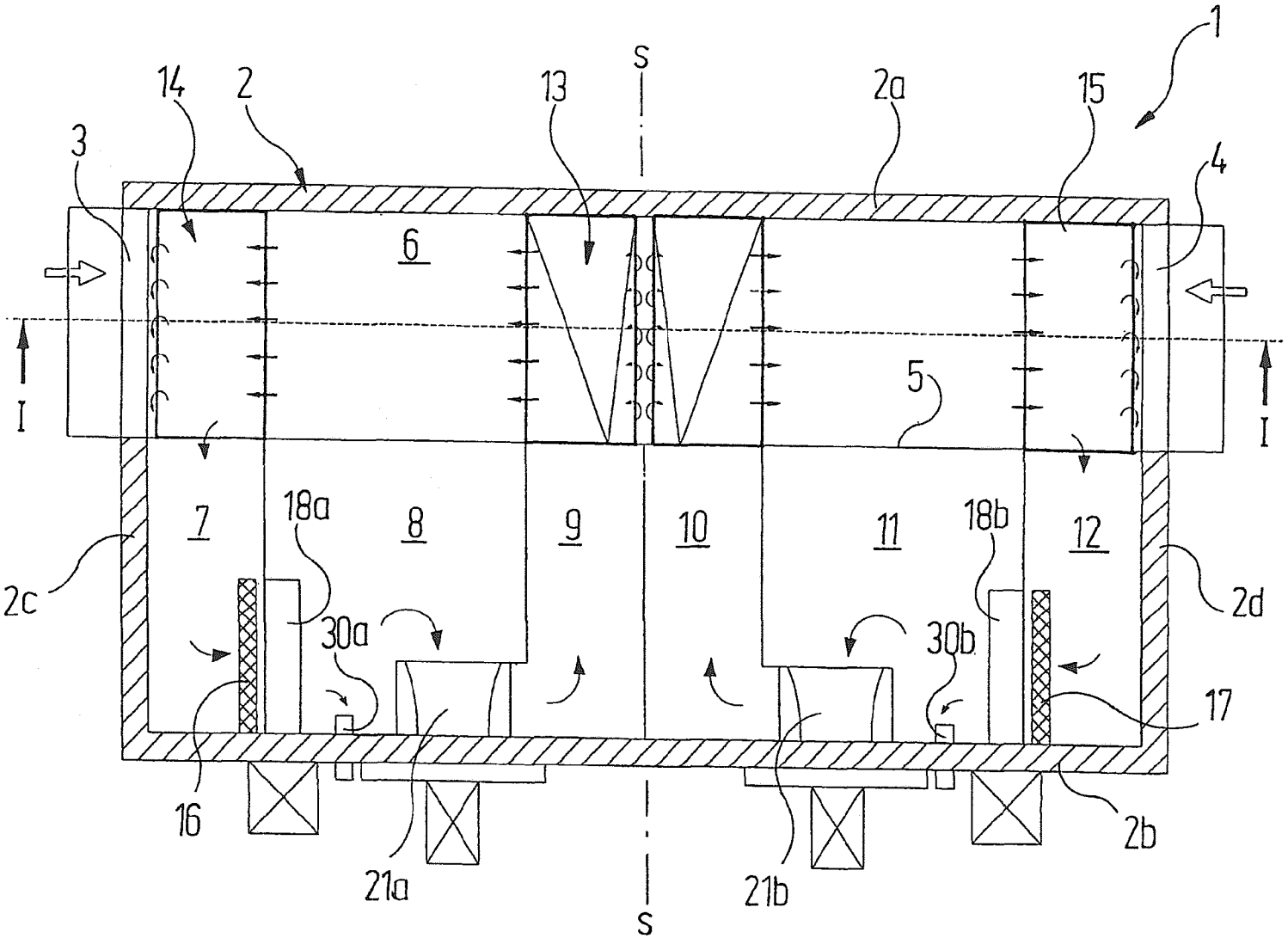
FIG. 2 a horizontal section through the oxidation furnace of FIG. 1.
Figure 3:
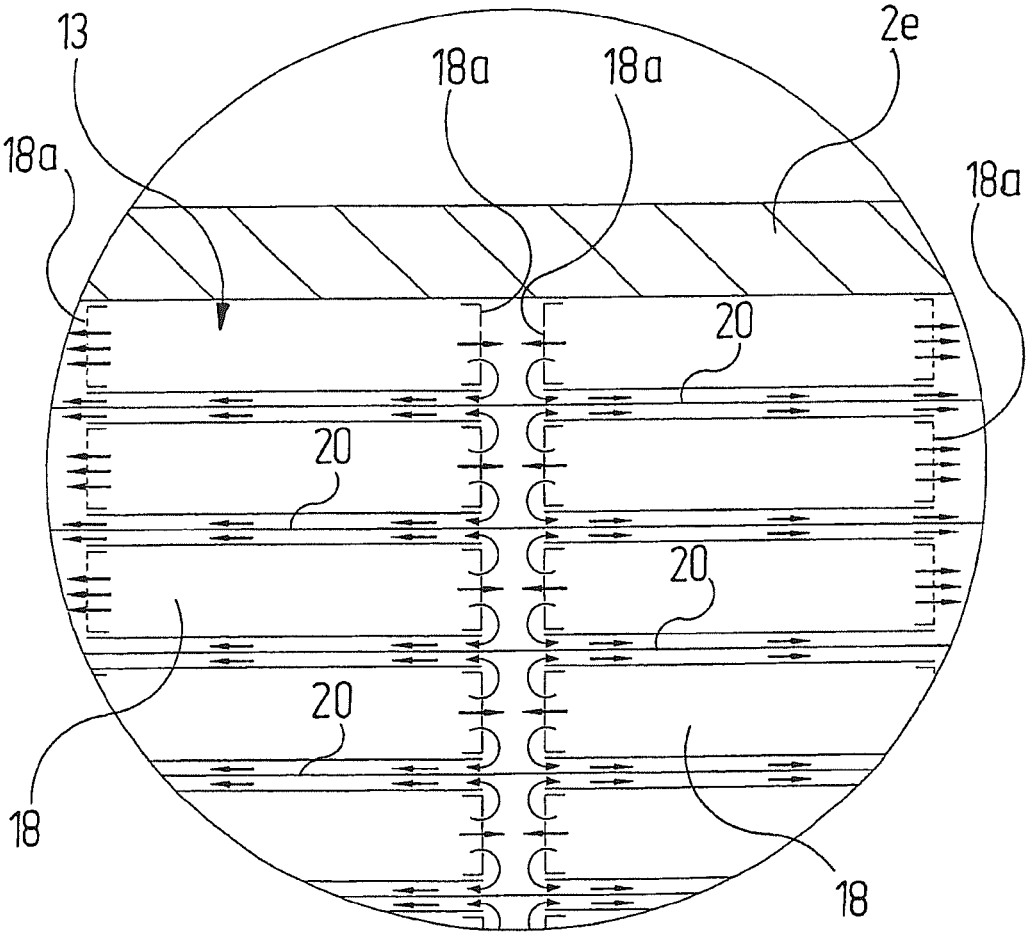
FIG. 3 a detailed enlargement from FIG. 1 in the region of a blowing device.

Reference is firstly made to FIGS. 1 to 3, which show a first exemplary embodiment of an oxidation furnace which is denoted as a whole by the reference numeral 1 and is used to produce carbon fibres. The oxidation furnace 1 comprises a housing 2 which is in turn composed of two vertical side walls 2*a*, 2*b*, two vertical end walls 2*c*, 2*d*, a top wall 2*e* and a base wall 2*f*. The housing 2 is gastight with the exception of two regions 3, 4 in the end walls 2*c* and 2*d*, in which the fibres 20 to be treated are conducted in and out and which are provided with special lock devices.

As shown in particular in FIG. 2, the interior of the housing 2 is divided by a vertical partition wall 5 into the actual process chamber 6 and air-conducting chambers 7, 8, 9, 10, 11, 12 located at the side of this process chamber. On the whole, the interior of the oxidation furnace 1 is constructed to be substantially mirror-symmetrical with respect to the vertical central plane S-S indicated in FIG. 2.

A blowing device, which is denoted as a whole by the reference numeral 13 and explained in more detail below, is located in the central region of the process chamber 6. Suction devices 14 and 15 are located in the two outer end regions of the process chamber 6, respectively adjacent to the entry and exit regions 3, 4.

Two directionally opposed air circuits are maintained inside the housing 2: Starting for example from the suction devices 14, 15, the air is conducted in the direction of the arrows shown in FIG. 2 through the air-conducting chambers 7 and 12 to a filter 16 and 17 and then through a heating unit 18*a* and 18*b* into the air-conducting chamber 8 and 11. The heated air is extracted from the air-conducting chamber 8 and 11 by a ventilator 21*a* and 21*b* and blown into the air-conducting chambers 9 and 10. From there, the air arrives in each case in one half of the blowing device 13 described in more detail below, flowing in opposite directions from there into the process chamber 6 and from there to the suction device 14 and 15 whereby the two air circuits are closed.

Two outlets 30*a*, 30*b* are provided in the wall of the housing 2. These can be used to discharge those volumes of gas or air which are either produced during the oxidation process or arrive in the process chamber 6 as fresh air by way of the entry and exit regions 3, 4 so as to maintain the air balance in the oxidation furnace 1. The discharged gases, which can also contain toxic constituents, are supplied for thermal afterburning. The heat produced thereby can be used at least to pre-heat the fresh air supplied to the oxidation furnace 1.

The detailed construction of the blowing device 13 is described as follows:

It comprises two "stacks" of blowing boxes 18. Each of these blowing boxes 18 is in the shape of a hollow cuboid, with the longer dimension extending transversely to the longitudinal direction of the process chamber 6 over its entire width. The narrow sides of the blowing boxes 18, which each face the process chamber 6, are constructed as perforated plates 18*a*. A respective end face of each blowing box 18 is in communication with the air-conducting chamber 9 and air-conducting chamber 10 so that the air delivered by the ventilator 20 and 21 is blown into the interior of the respective blowing box 18 and can exit from there by way of the perforated plates 18*a*.

The various blowing boxes 18 in each of the two stacks are arranged at a slight spacing above one another; the two stacks of blowing boxes 18, as seen in the longitudinal direction of the furnace or the movement direction of the filaments 20, are in turn likewise spaced from one another. Ideally (and deviating from the relationships shown in FIG. 1), the vertical spacing between two blowing boxes 18 in a stack is the same as the spacing between the two stacks 18 in the longitudinal direction of the process chamber 6.

The two suction devices 14, 15 are formed substantially by a respective stack of suction boxes 19 which extend in a manner similar to the blowing boxes 18 in the transverse direction through the entire process chamber 6 and are constructed as perforated plates 19*a* at their narrow sides extending transversely to the longitudinal extent of the process chamber 6. The holes of the perforated plates 19*a* can be of any geometrical shape here. The suction boxes 19 in the suction devices 14, 15 are at the same vertical spacing from one another as the blowing boxes 18 in the blowing device 13.

The fibres 20 to be treated are supplied to the oxidation furnace 1 by way of a deflection roller 21 and pass through a lock device 22 here, which is not of interest in the present connection and serves to prevent gas from escaping outwards from the process chamber 6. The fibres 20 are then guided through the clearances between suction boxes 19 located above one another, through the process chamber 6, through the clearances between blowing boxes 18 located above one another in the blowing device 13, through the clearance between suction boxes 19 located above one another at the opposite end of the process chamber 6 and through a further lock device 23.

The outlined passage of the fibres 20 through the process chamber 6 is repeated a plurality of times in serpentine manner, for which a plurality of deflection rollers 24 and 25 with their axes arranged parallel above one another are provided in both end regions of the oxidation furnace 1. After the uppermost passage through the process chamber 6, the fibre 20 exits the oxidation furnace 1 and is guided here by way of a further deflection roller 26.

During the serpentine passage of the fibres 20 through the process chamber, these are surrounded by hot, oxygen-containing air and thereby oxidised. The exit from the oxidation furnace 1 substantially completes at least one oxidation step. Further oxidation steps can follow.

FIG. 3 shows the movement of the air flows in the region of the blowing device 13. As a result of the perforated plates 18*a* provided on both narrow longitudinal sides of the inlet boxes 18, the air which is blown into the interior of each blowing box 18 by the corresponding ventilator 20 and 21 can exit at both opposite sides of the blowing box 18. In the region of the gap between two stacks of blowing boxes 18, the air flows thereby meet in opposite directions, as shown in FIG. 3. This causes the air to turn there and flow through the clearance between blowing boxes 18 located above one another in each of the two stacks in the direction of the opposite end regions of the process chamber 6 and therefore the corresponding suction device 14, 15. This proportion of the air delivered by the blowing boxes 18 also flows around the fibres 20 here in the paths located between the blowing boxes 18. These paths are therefore effective for the oxidation procedure. Therefore, with the same furnace length, it is possible to reduce the furnace height compared to oxidation furnaces according to the prior art as outlined at the outset. The advantages linked to this have already been referred to above.

Figure 4:
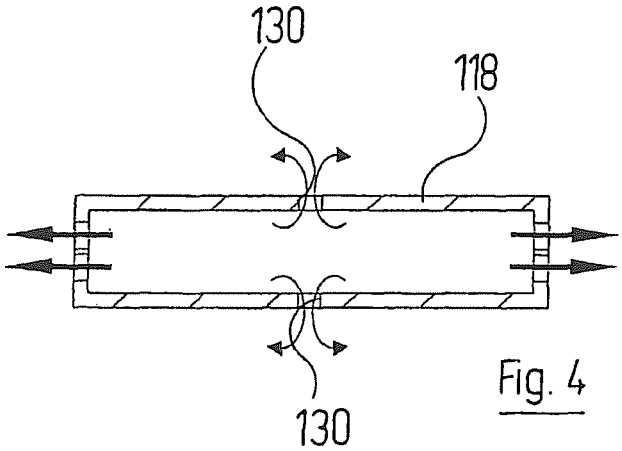
FIG. 4 a section through a plan view of a blowing box as used in an alternative exemplary embodiment of an oxidation furnace, according to the line IV-IV of FIG. 5.
Figure 5:
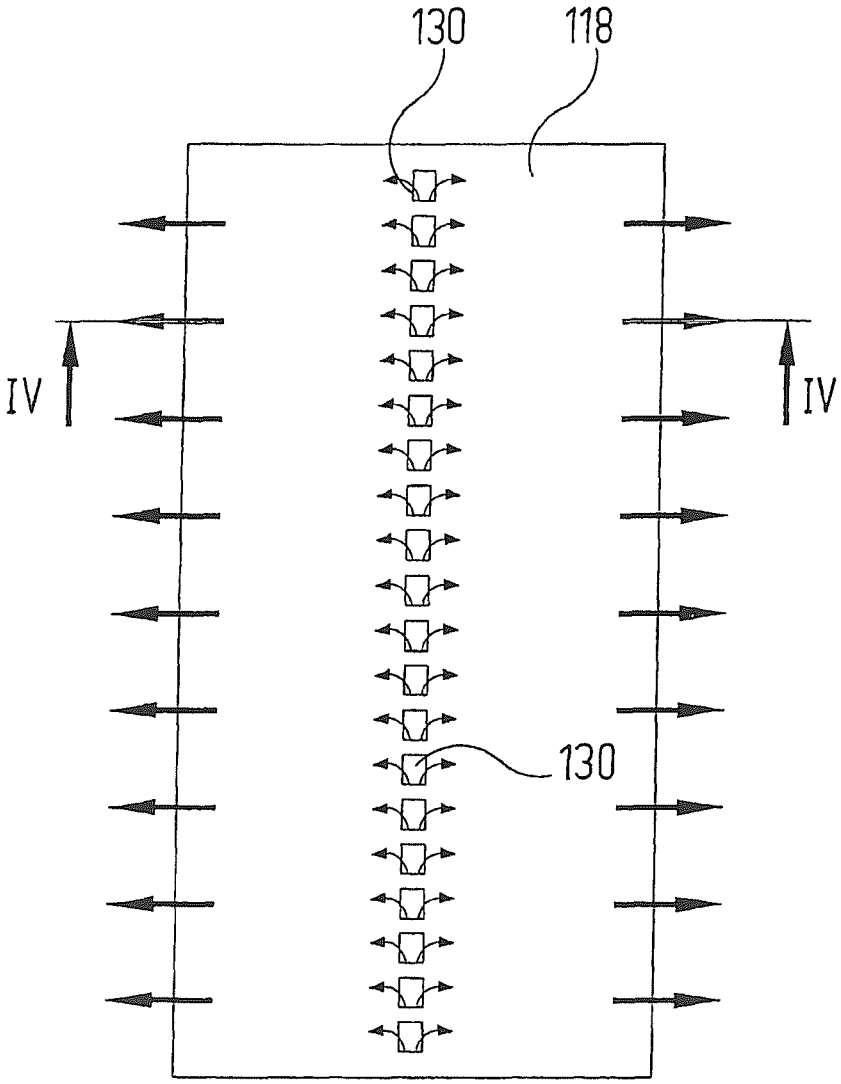
FIG. 5 a plan view of the blowing box of FIG. 4.

FIGS. 4 and 5 shows a blowing box 118 which can be used in an alternative exemplary embodiment of an oxidation furnace and can, in each case, replace a pair of blowing boxes 18 of FIGS. 1 to 3 which, in this exemplary embodiment, are located at the same height next to one another in two different "stacks". Instead of two individual blowing boxes 18 arranged at a spacing as seen in the longitudinal direction of the process chamber 6, a common blowing box 118 can be used, whereof the dimensions as seen parallel to the longitudinal direction of the process chamber 6 correspond to the sum of the corresponding dimensions of two blowing boxes 18 of FIG. 1.

Instead of the gap between two mutually adjacent blowing boxes 18, the blowing box 118 according to FIGS. 4 and 5 has, in each case, a plurality of air outlet openings 130 in the top and bottom sides so that air can therefore escape from the (common) blowing box 118 at the top side and bottom side, as indicated by the arrows in FIGS. 4 and 5. This enables a flow pattern to be achieved which is similar to that shown in FIG. 3: It is also possible for air flows to develop along the bottom and top sides of the blowing boxes 118 parallel to the movement direction of the fibres, which air flows surround the fibres between the blowing boxes and trigger the oxidation procedure there.

In the case of FIGS. 4 and 5, the air-conducting chambers 9 and 10 of FIG. 2 are combined and supply the blowing boxes 118 together.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. An oxidation furnace for the oxidative treatment of fibres, comprising:

a) a housing which is gastight apart from inlet and outlet regions for fibres;

b) a process chamber located in an interior of the housing;

c) a blowing device which is arranged in central region of the process chamber and by means of which hot air is blown in opposite directions into the process chamber and which comprises a plurality of blowing boxes which are arranged at a vertical spacing above one another and have respective exit openings on opposite sides for the hot air;

d) a suction device in both opposite end regions of the process chamber, which extracts hot air from the process chamber;

e) at least one ventilator which circulates the hot air through the blowing device, the process chamber and the two suction devices;

f) at least one heating device located in a flow path of the hot air;

g) guide rollers which guide the fibres in serpentine manner through clearances between blowing boxes located above one another; wherein h) two stacks of blowing boxes are provided, and which are arranged at a spacing behind one another as seen in a movement direction of the fibres.

2. An oxidation furnace according to claim 1, wherein a horizontal spacing between the two stacks of blowing boxes is equal to double the vertical spacing between the blowing boxes in the stack and, at the most, equal to a longitudinal dimension of a blowing box.

3. An oxidation furnace according to claim 1, wherein the blowing boxes each have at least one additional exit opening for hot air along a centre line on a top side and a bottom side.

4. An oxidation furnace for the oxidative treatment of fibres, comprising:

a housing which is gastight apart from inlet and outlet regions for fibres;

a process chamber located in an interior of the housing;

a blowing device which is arranged in central region of the process chamber and by means of which hot air is blown in opposite directions into the process chamber and which comprises a plurality of blowing boxes which are arranged at a vertical spacing above one another and have respective exit openings on opposite sides for the hot air;

a suction device in both opposite end regions of the process chamber, which extracts hot air from the process chamber;

at least one ventilator which circulates the hot air through the blowing device, the process chamber and the two suction devices;

at least one heating device located in a flow path of the hot air;

guide rollers which guide the fibres in serpentine manner through clearances between blowing boxes located above one another; wherein the blowing boxes have at least one additional exit opening for hot air in a top side and a bottom side.

5. The oxidation furnace according to claim 4, wherein two stacks of blowing boxes are provided, and which are arranged at a spacing behind one another as seen in a movement direction of the fibres.

6. An oxidation furnace according to claim 5, wherein a horizontal spacing between the two stacks of blowing boxes is equal to double the vertical spacing between the blowing boxes in the stack and, at the most, equal to a longitudinal dimension of a blowing box.

7. An oxidation furnace according to claim 4, wherein the blowing boxes each have a plurality of additional exit openings for hot air along a centre line on a top side and a bottom side.

* * * * *